US010753121B2

(12) United States Patent
Morse et al.

(10) Patent No.: US 10,753,121 B2
(45) Date of Patent: Aug. 25, 2020

(54) PRIVACY LOCK

(71) Applicant: Spectrum Brands, Inc., Middleton, WI (US)

(72) Inventors: Thomas P. Morse, Wyomissing, PA (US); Eric Xin, Xiamen (CN); James Lin, Laguna Niguel, CA (US)

(73) Assignee: Spectrum Brands, Inc., Middleton, WI (US)

( * ) Notice: Subject to any disclaimer, the term of this patent is extended or adjusted under 35 U.S.C. 154(b) by 720 days.

(21) Appl. No.: 15/333,662

(22) Filed: Oct. 25, 2016

(65) Prior Publication Data

US 2017/0122002 A1 May 4, 2017

Related U.S. Application Data

(60) Provisional application No. 62/250,201, filed on Nov. 3, 2015.

(51) Int. Cl.

| | |
|---|---|
| ***E05B 13/00*** | (2006.01) |
| ***E05B 63/00*** | (2006.01) |
| ***E05B 3/06*** | (2006.01) |
| ***E05C 1/16*** | (2006.01) |
| ***E05B 15/04*** | (2006.01) |
| ***E05B 55/00*** | (2006.01) |

(52) U.S. Cl.

CPC ..... *E05B 13/004* (2013.01); *E05B 3/065* (2013.01); *E05B 15/04* (2013.01); *E05B 55/005* (2013.01); *E05B 63/0069* (2013.01); *E05C 1/163* (2013.01); *E05B 63/0065* (2013.01); *Y10T 292/82* (2015.04); *Y10T 292/96* (2015.04)

(58) Field of Classification Search

CPC .. Y10T 292/82; Y10T 292/865; Y10T 292/96
USPC ..... 292/347, 348, 359; 70/467–152
See application file for complete search history.

(56) References Cited

U.S. PATENT DOCUMENTS

| | | | | |
|---|---|---|---|---|
| 2,263,477 | A | 11/1941 | Voight | |
| 2,386,868 | A | 10/1945 | Karczewski | |
| 2,400,403 | A * | 5/1946 | Falk | E05C 1/163 292/359 |
| 2,420,114 | A | 5/1947 | Henst | |
| 2,499,948 | A | 3/1950 | Egor | |
| 2,593,573 | A | 4/1952 | Kulbersh | |
| 2,605,124 | A | 7/1952 | Hillgren | |
| 2,653,047 | A * | 9/1953 | Sultan | E05C 1/163 292/359 |
| 2,723,874 | A | 11/1955 | Hillgren | |
| 3,212,806 | A | 10/1965 | Riussell et al. | |
| 4,142,748 | A * | 3/1979 | Hook | E05B 3/065 292/169.15 |
| 4,143,529 | A * | 3/1979 | Brummett | E05B 55/005 292/150 |

(Continued)

FOREIGN PATENT DOCUMENTS

| | | | | |
|---|---|---|---|---|
| EP | 1717389 A1 * | 11/2006 | | E05B 13/004 |

*Primary Examiner* — Carlos Lugo
(74) *Attorney, Agent, or Firm* — Merchant & Gould P.C.

(57) ABSTRACT

A privacy lock assembly and method of operation are provided. The lock assembly has a push button offset from the central axis of the lock assembly for locking and unlocking the assembly. The lock assembly includes compression springs to maintain integrated handles in predetermined orientations when the handles are not subject to a load.

20 Claims, 8 Drawing Sheets

(56) References Cited

U.S. PATENT DOCUMENTS

| | | | | | |
|---|---|---|---|---|---|
| 4,866,965 | A * | 9/1989 | Urdal | E05B 13/004 | 70/481 |
| 5,067,758 | A * | 11/1991 | Fann | E05B 3/065 | 292/244 |
| 5,083,823 | A * | 1/1992 | Fann | E05B 3/065 | 292/150 |
| 5,286,074 | A * | 2/1994 | Lin | E05B 13/002 | 292/150 |
| 5,505,508 | A * | 4/1996 | Kuo | E05B 13/004 | 292/169.17 |
| 5,562,317 | A * | 10/1996 | Kuo | E05B 3/06 | 292/359 |
| 5,826,924 | A * | 10/1998 | Huang | E05B 13/004 | 292/359 |
| 5,941,108 | A | 8/1999 | Shen | | |
| 6,502,872 | B1 | 1/2003 | Molzer | | |
| 6,553,799 | B2 | 4/2003 | Bates et al. | | |
| 6,568,231 | B1 * | 5/2003 | Huang | E05B 13/004 | 292/358 |
| 6,644,077 | B1 * | 11/2003 | Huang | E05B 13/004 | 292/358 |
| 7,387,005 | B2 * | 6/2008 | Huang | E05B 65/0035 | 292/336.3 |
| 7,900,978 | B2 * | 3/2011 | Zimmer | E05B 3/065 | 292/100 |
| 8,047,586 | B2 * | 11/2011 | Pilotelli | E05B 3/065 | 292/336.3 |
| 2005/0046203 | A1 | 3/2005 | Huang | | |
| 2005/0225097 | A1 | 10/2005 | Geringer et al. | | |

* cited by examiner

PRIVACY LOCK

RELATED APPLICATIONS

This application claims the benefit of U.S. Provisional Application Ser. No. 62/250,201 filed Nov. 3, 2015 for a "Privacy Lock", which is hereby incorporated by reference in its entirety.

TECHNICAL FIELD

The present disclosure relates generally to locking devices. In particular, this disclosure relates to a privacy lock with an emergency exit feature.

SUMMARY

According to one aspect, the present disclosure relates to a privacy door lock with a lock assembly including a chassis having exterior and interior portions. A spindle extends between the exterior and interior portions to translate a door latch. An exterior spring housing and an interior spring housing may be coupled to the exterior and interior portions of the chassis. The interior spring housing and the exterior housing each have compression springs. A locking mechanism having a locking piece engages with a toggle offset from a central axis of the chassis to secure the lock assembly in a locked position. In some embodiments, the lock assembly provides means for unlocking the lock assembly from the interior portion by a camming motion so that the toggle is translated out of engagement with the locking piece, thereby allowing the locking piece to rotate with the spindle.

In illustrative embodiments, the lock assembly may include a chassis with an exterior and interior portion configured to extend from an exterior and interior of a door. A spindle may be provided that extends between the exterior and interior portion to translate a door latch bolt. An exterior spring housing and an interior spring housing may be coupled to the exterior and interior portions of the chassis. The interior spring housing and the exterior housing may each have compression springs. A locking mechanism may be provided having a locking piece that is keyed to engage with a toggle offset from a central axis of the chassis to secure the lock assembly in a locked position. The locking piece is keyed to receive a tail piece of the toggle. Translation of the tail piece out of the keyed locking piece unlocks the lock assembly into an unlocked position.

In another embodiment, a method of operating a door locking assembly includes providing a lock assembly chassis having an interior portion including compression springs and an exterior portion including compression springs, the interior portion and exterior portion connected via a spindle which translates a latch bolt. The door may be locked by pressing a lock actuator toggle, offset from an axis of rotation along the center of the chassis, into a keyed opening of a locking piece in the interior portion of the chassis. The door may be unlocked by camming the toggle out of the keyed opening of a locking piece.

Additional features of the present disclosure will become apparent to those skilled in the art upon consideration of illustrative embodiments including the best mode of carrying out the disclosure as presently perceived.

BRIEF DESCRIPTION OF THE FIGURES

The detailed description makes reference to the accompanying figures in which.

DETAILED DESCRIPTION

The disclosure generally relates to a privacy lock assembly. Privacy door locks are often used in bedrooms and/or bathrooms, but this disclosure is not intended to be limited to a particular room or location in which the lock is installed. The lock assembly can be locked by actuating a push button on the interior assembly. Depending on the circumstances, the unlocking button could be offset from, and not incorporated into the handle, which provides more flexibility in the handle's aesthetic design. The lock assembly can be unlocked solely by actuating the interior handle, which provides an emergency exit feature for users to easily unlock the lock assembly and exit a room. An emergency key is provided to unlock the lock assembly from the exterior assembly side. The lock assembly may incorporate spring housings to maintain interior and exterior handles in a predetermined orientation in the unloaded position.

Figure 1:
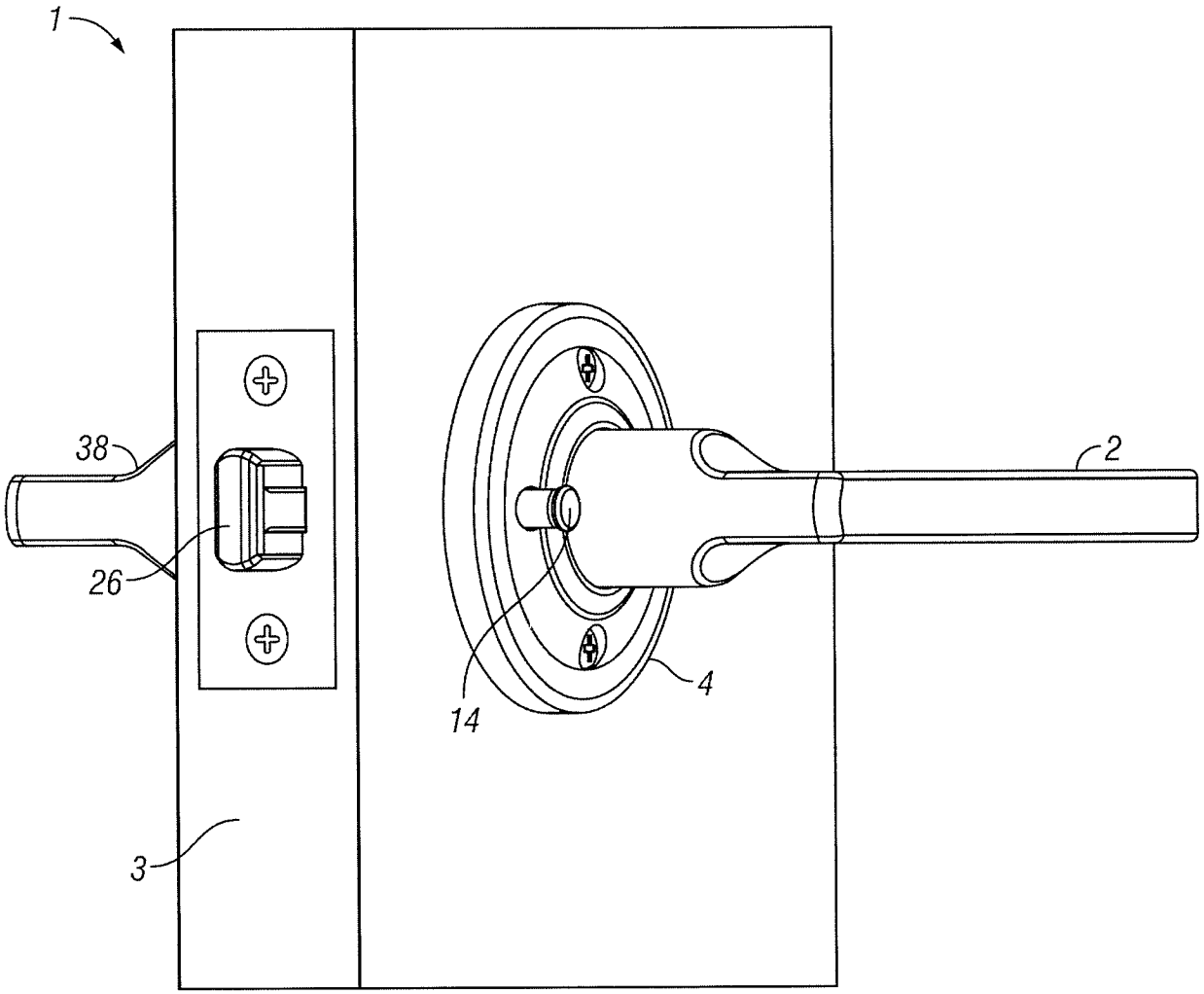
FIG. 1 is a perspective view of a cut away of a door on which a lock assembly according to an embodiment of the disclosure is installed.

FIG. 1 illustrates a privacy lock assembly 1 according to an embodiment of the present disclosure. In the example shown, the privacy lock assembly 1 includes an interior handle 2, an interior rose 4, and a button 14 arranged on an interior side of a door 3 opposite an exterior handle 38 mounted on an opposite side of the door 3. The interior rose 4 could be many different sizes and shapes depending on the desired aesthetic qualities of the lock assembly 1. The handles 2, 38 are shown as levers in FIG. 1 purposes of example, but could be embodied as knobs or other types of handles. When the privacy lock assembly 1 is in an unlocked position, a bolt 26 is operably movable by the interior and exterior handles 2, 38 between an extended and retracted position. As shown, the bolt 26 is in the extended position, but when the privacy lock assembly 1 is in the unlocked position, the rotation of either handle 2, 38 moves the bolt 26 to a retracted position. In the embodiment shown, the button 14 may be pushed to lock the lock assembly 1. In a locked position, the exterior handle 38 cannot actuate the bolt 26 to the retracted position. However, even in the locked position, the interior handle 2 can actuate the bolt 26 to the retracted position which is an emergency exit feature that allows a person to exit a room by solely activating the interior handle 2 to unlock the lock assembly 1. As shown, the button 14 is offset from an axis about which the interior handle 2 rotates. In the example shown, the button 14 extends through the interior rose 4.

Figure 2:
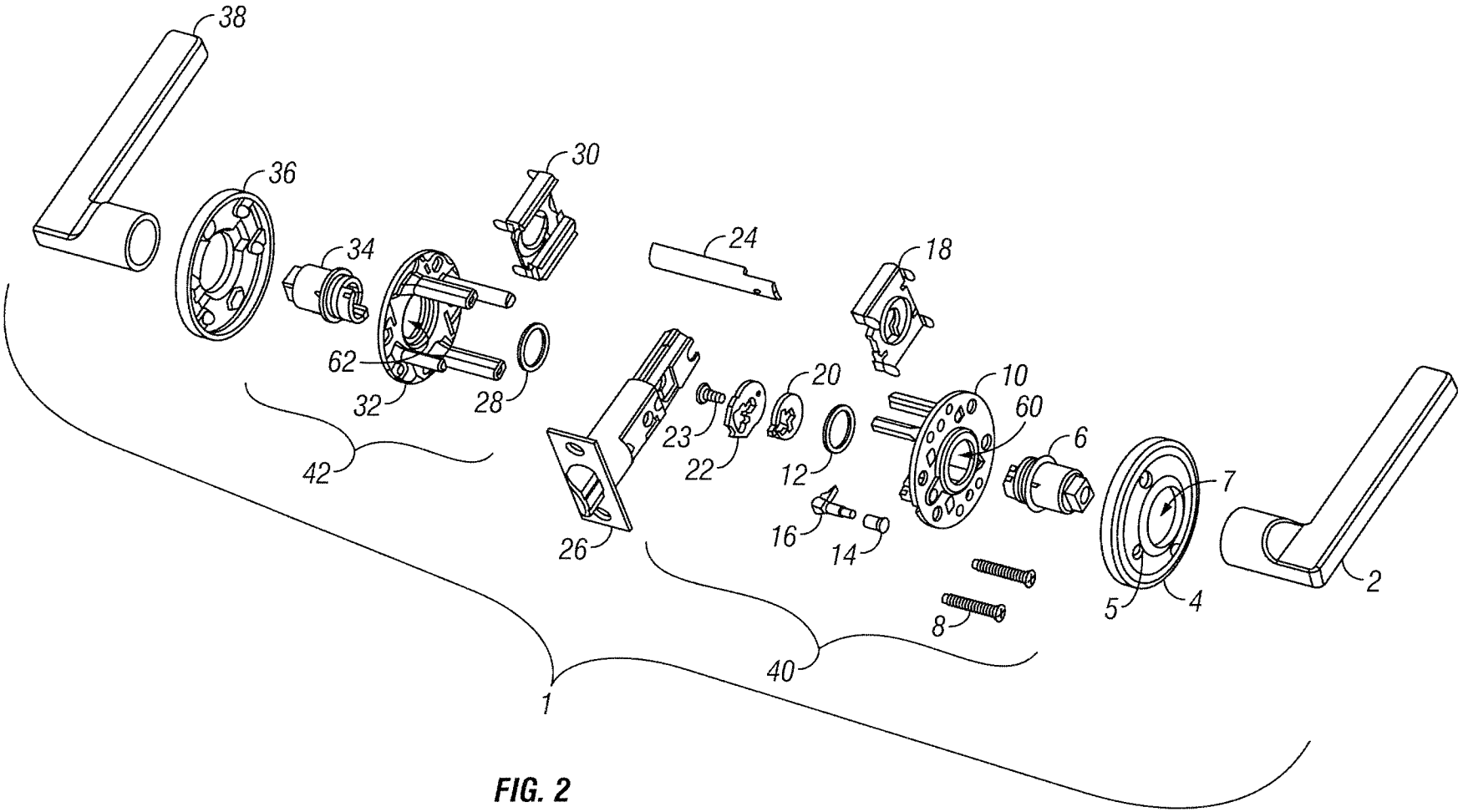
FIG. 2 is an exploded view of the example lock assembly shown in FIG. 1.

Referring to FIG. 2, the privacy lock assembly 1 includes an interior chassis 40 and an exterior chassis 42. The interior chassis 40 includes an interior insert 6 that extends through the opening 7 in interior rose 4 and into the interior handle 2. An interior liner 10 is received by a recessed area of the interior rose 4. The interior liner 10 also provides an opening 60 to receive an end of the interior insert 6. The interior insert 6 extends through the interior liner 10 and is retained in place by a clip 12. The interior rose 4 includes an opening 5 through which a button 14 extends in mating connection with toggle 16. As shown, the opening 5 is offset from an opening 7 through which handle 2 extends through rose 4. The interior spring housing 18 connects to interior liner 10 so that interior insert 6 extends into and through the interior spring housing 18. An unlocking piece 20 and a locking piece 22 are mounted to the interior insert 6 via fastener 23.

The exterior chassis 42 includes an exterior insert 34 that extends through the exterior rose 36 and into the exterior handle 38. The exterior liner 32 nests in the exterior rose 36 and also provides an opening 62 to receive an end of the exterior insert 34. A clip 28 couples the exterior insert 34 to the exterior liner 32. The opposite end of the exterior insert 34 extends through the rose 36 and is coupled with the exterior handle 38. An exterior spring housing 30 connects to the exterior insert 34 so that exterior insert 34 extends into and through the exterior spring housing 30. A spindle 24 is configured to mate in the opening 60 of interior insert 6 and the opening 62 in exterior insert 34 and extend through the latch assembly 26 to control locking and unlocking. The locking assembly includes mounting fasteners 8, that extend through openings in the interior rose 4 and threadingly engage with interior openings in the exterior rose 36.

Figure 3:
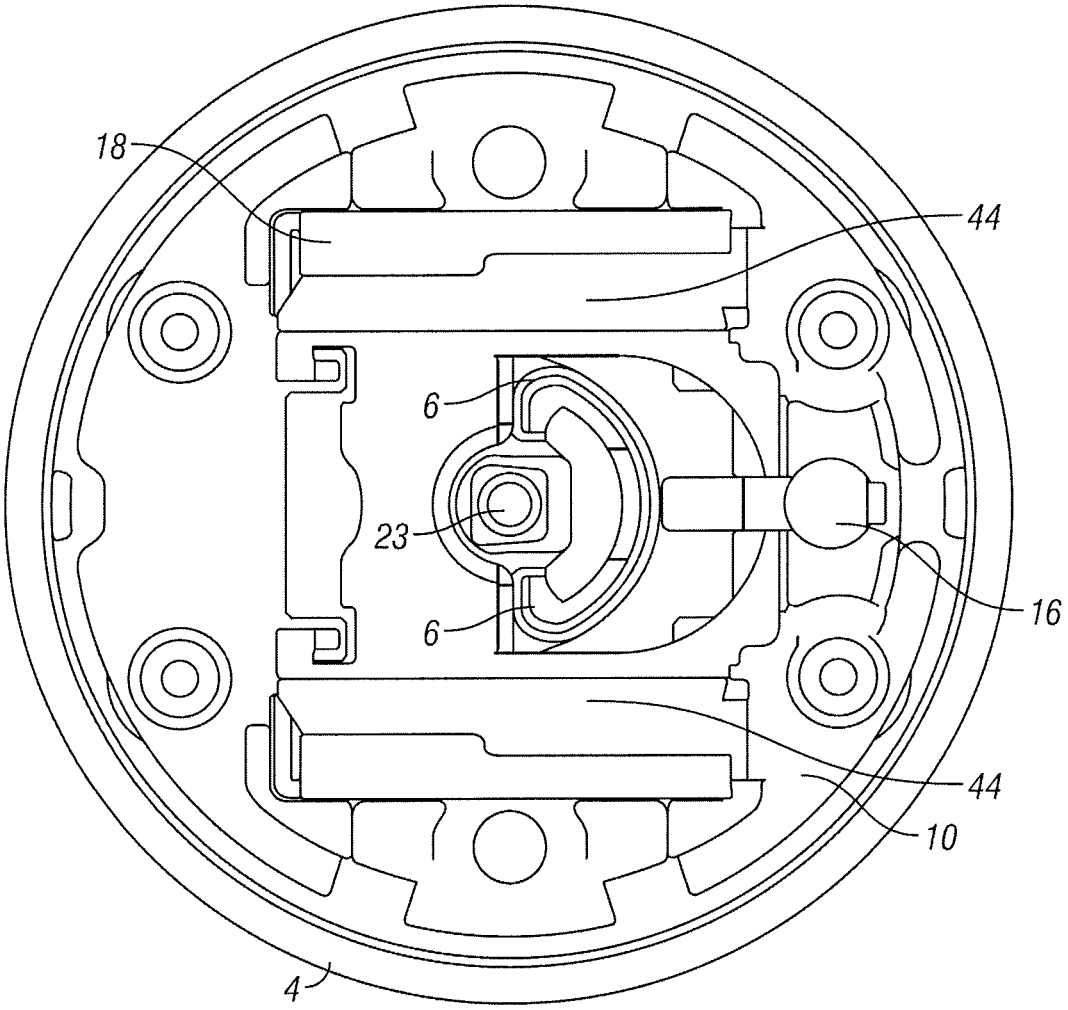
FIG. 3 is a rear view of the interior chassis of the example lock assembly shown in FIG. 1.
Figure 4:
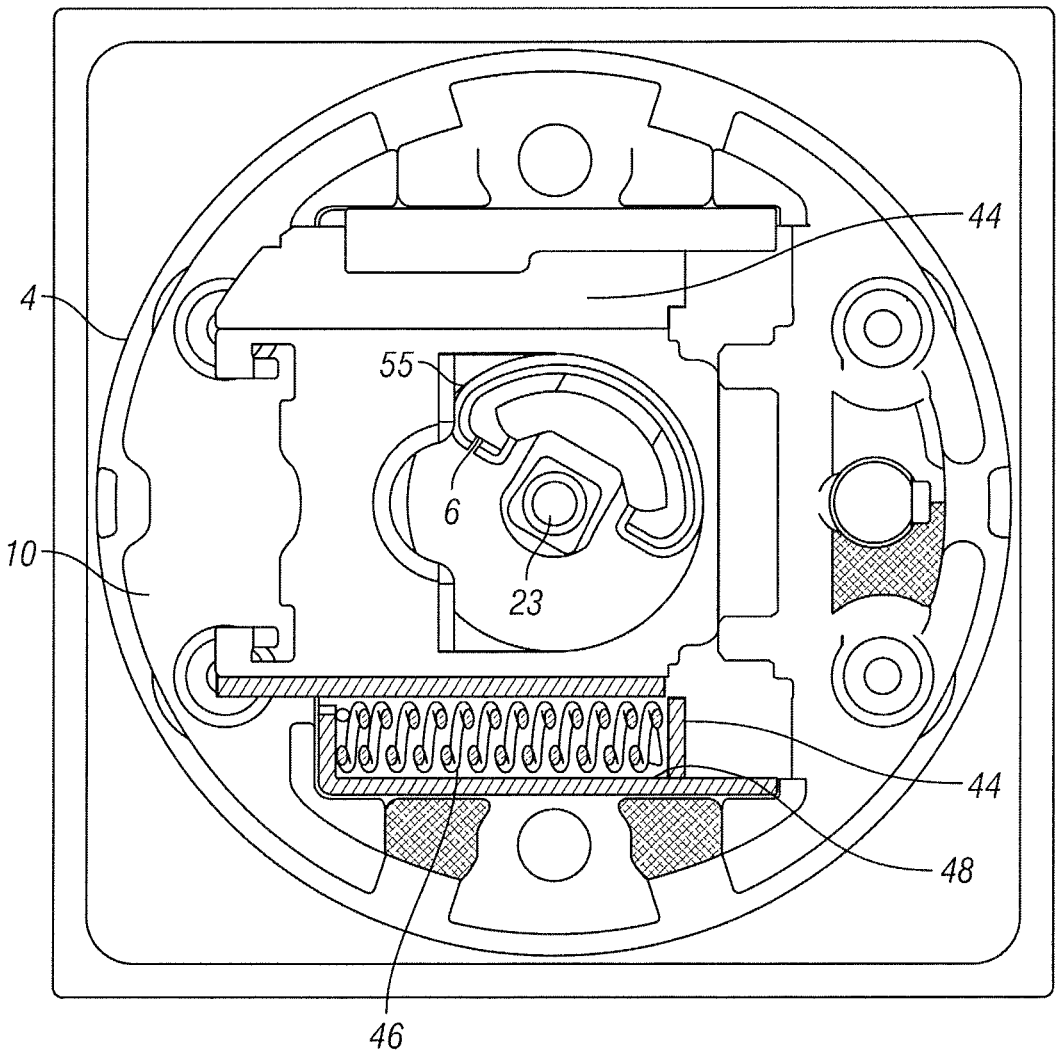
FIG. 4 is a rear cross-sectional view of the interior chassis with a partial cutaway of the interior spring housing of the example lock assembly shown in FIG. 1.
Figure 5:
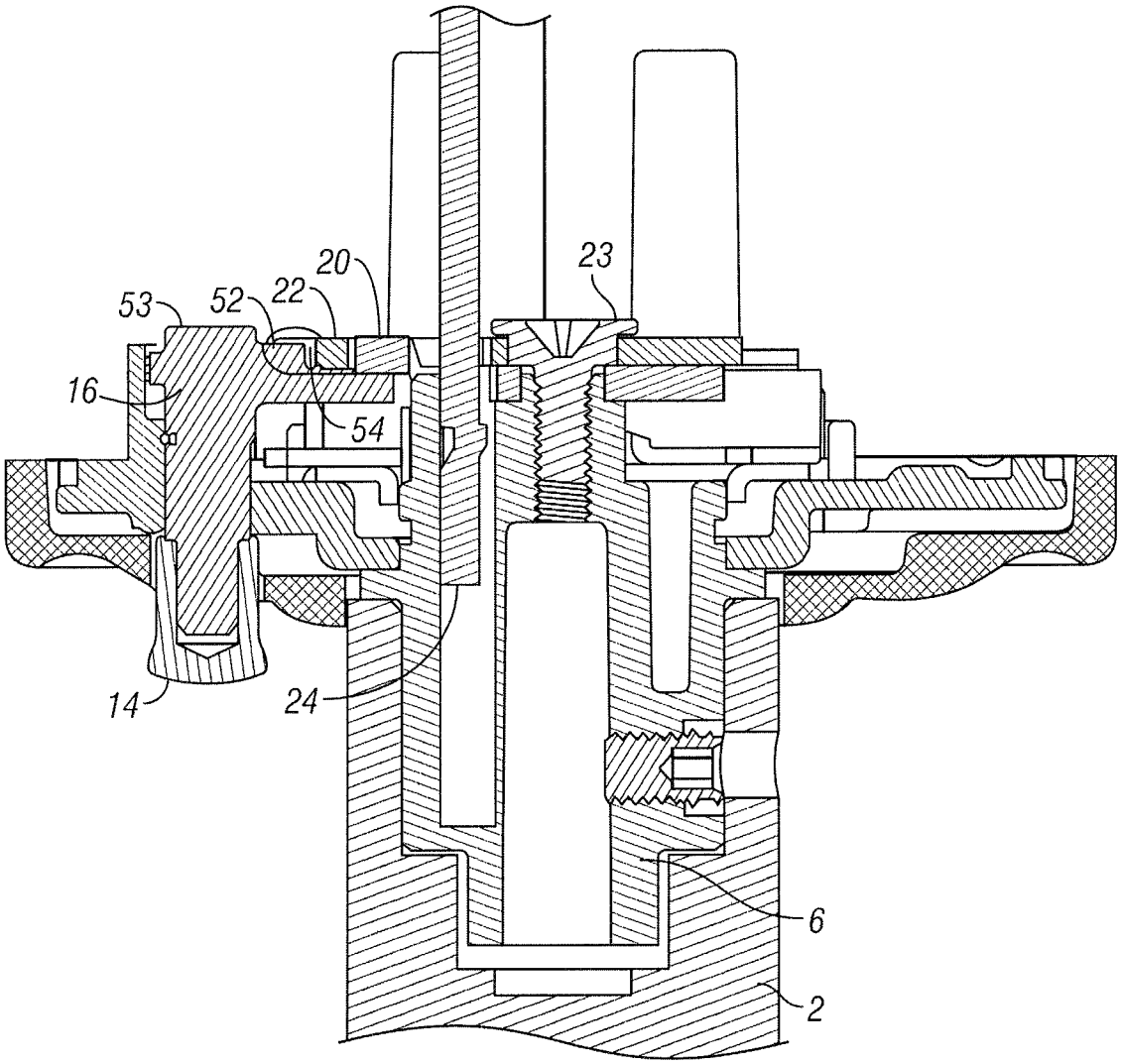
FIG. 5 is a top cross-sectional view of the lock assembly of FIG. 1 in the locked position.

Referring to FIGS. 3-5, the interior spring housing 18 includes a translating spring compressing plate 44 and an opening 54 (FIG. 5) with a portion proximate where the fastener 23 is positioned when no external load is applied to the interior handle 2 or exterior handle 38. The internal orientation as shown in FIG. 3, corresponds to a predetermined orientation of interior and exterior handles 2, 38 without a load such as the orientation shown in FIG. 1.

FIG. 4 illustratively shows the interior spring housing 18 when an external load or force is applied to the interior and/or exterior handles 2, 38 (e.g., when a user rotates the handle 2). As can be seen, the interior insert 6 rotates in response to such a force so that the spring compressor plate 44 translates along a track provided by the interior spring housing 18 and top compressing walls 48 compress springs 46 in the housing. The springs 46, as shown in this embodiment, include a pair of compression springs in each spring housing 18, 30.

In the embodiment shown, springs 46, lie above and below predetermined horizontal axis of handle 2. This results in equal force applied by each spring 46 on each side of the handle 2 and ensures a precise unloaded orientation. However, it is contemplated that more than a pair of springs in each spring housing may be employed. In a rotated loaded position, the interior insert 6 contacts a wall 55 of opening (FIG. 4). An equivalent rotation of the external insert 43 and corresponding translation of an exterior spring compressor plate (not shown) occurs in exterior spring housing 30 due to the connection of the interior and exterior inserts via the spindle 24. The interior insert 6 is configured to have a predetermined amount of rotation in either direction where it does not engage the rotation of the spindle 24. Therefore, the interior insert 6 can rotate to return to the predetermined orientation by urging of compression springs 46 without engaging further rotation of the spindle 24.

When an applied load is removed from the handles 2, 38, (e.g., when a user releases the handle) the energy stored in the compressed springs 46 of the interior and exterior spring housings 18, 30 will expand and force spring compressor plate 44 to translate back to the initial position, thereby rotating interior and exterior inserts 6, 34 back to initial unloaded positions as seen in FIG. 3. This will result in corresponding rotation of internal and external handles 2, 38 to initial unloaded positions described above.

Figure 6:
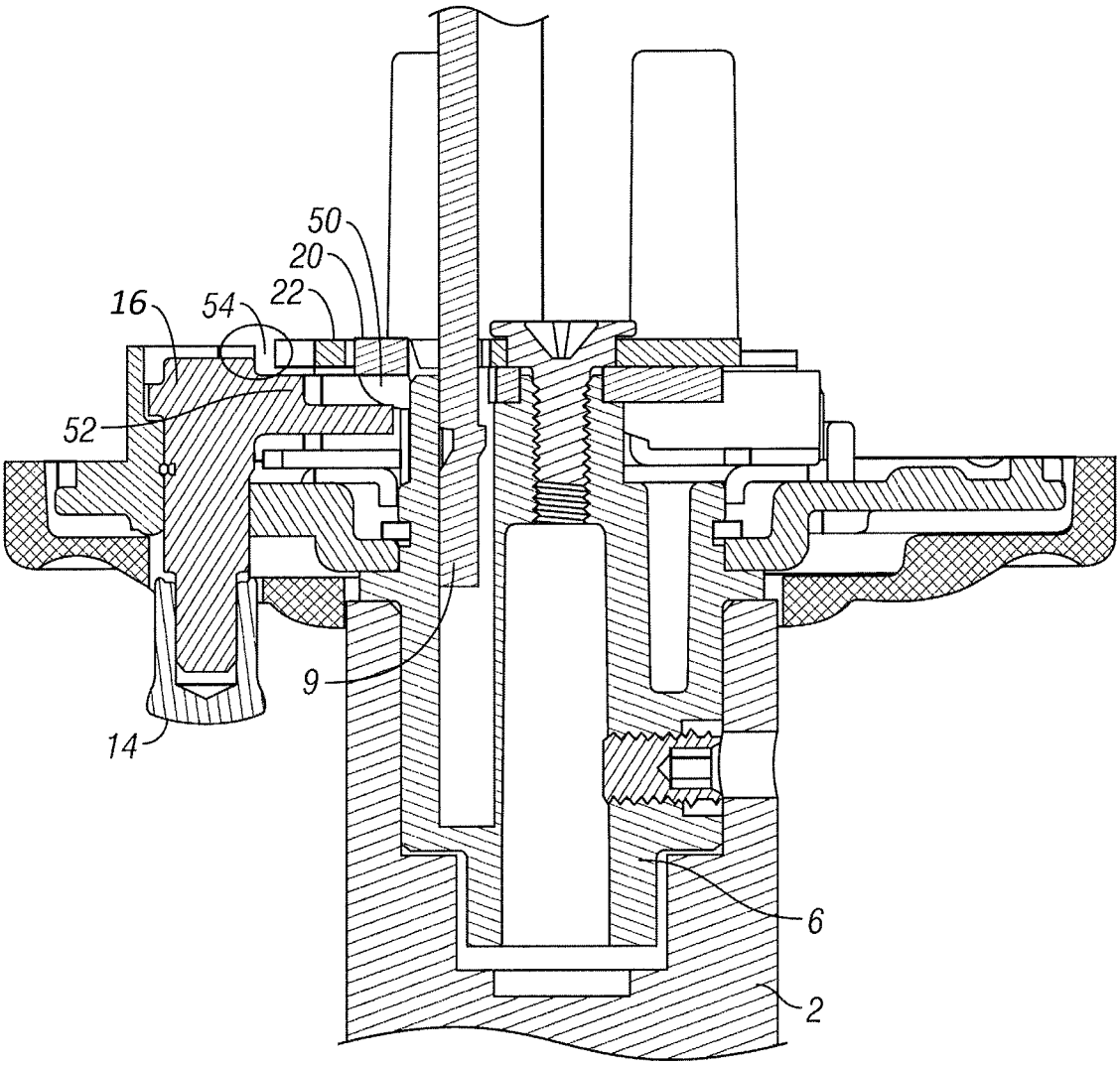
FIG. 6 is a top cross-sectional view of the lock assembly of FIG. 1 in the unlocked position.
Figure 7:
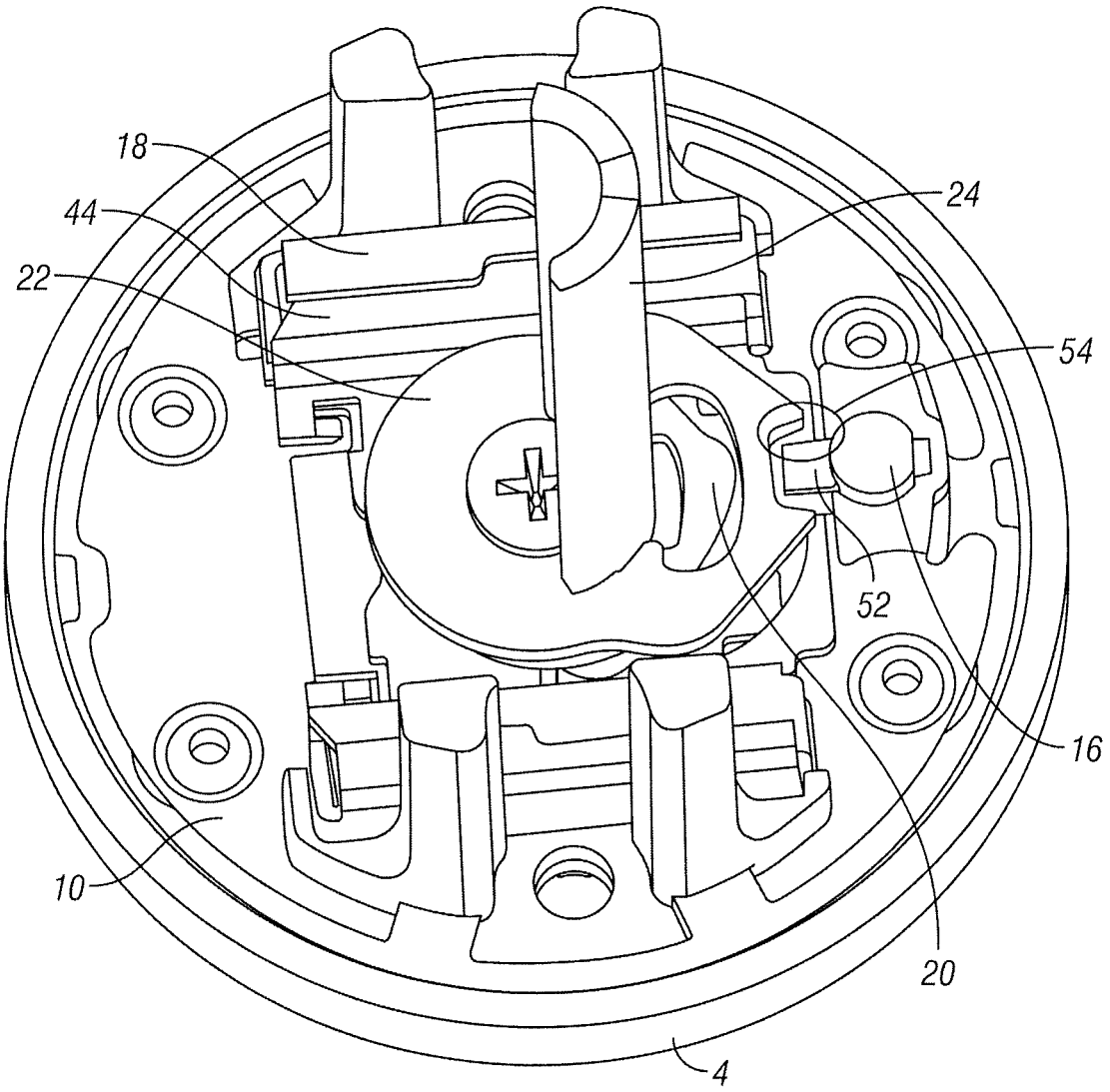
FIG. 7 is a rear perspective view of the interior chassis of the lock assembly of FIG. 1 in the unlocked position.

As shown in FIGS. 5-7, the privacy lock assembly 1 may also be locked or unlocked via the internal chassis 40. FIG. 5 illustrates the lock assembly 1 in a locked position. In this position toggle 16, which includes a head 53 and a tail 52, is translated into a keyed opening or notch 54 in locking piece 22. The translation can be actuated by button 14 that mates with toggle 16. In one embodiment, the button 14 is laterally offset from and parallel to the longitudinal axis of the interior insert 6, spindle 24 and/or, and the longitudinal axis of the portion of the handle that is inserted through the interior rose 4. When the tail 52 is located in the notch 54, the locking piece 22 is unable to rotate and is in a locked position. This locked configuration prevents the spindle 24 from rotating, which in turn, prevents rotation of the exterior handle 38. (The interior insert 6 can still rotate when the spindle 24 is locked).

In an unlocked configuration, ramped segment 50 of unlocking piece 20 is rotated to contact a distal end of tail 52 of toggle 16. This results in translation of toggle tail 52 out of notch 54 as seen in FIGS. 6-7. This translates toggle 16 out of and away from notch 54.

To rotate the ramped portion 50 of the unlocking plate 20 to displace the toggle 16 as illustrated, a user merely has to rotate the internal handle 2. The unlocking piece 20 is configured to rotate with interior insert 6. This provides an emergency exit feature in which the user can unlock the lock assembly 1 by turning the interior handle 2. Alternatively, a user at the interior handle 2 could pull the button 14 away from the interior rose 4.

As seen in FIG. 7, when in the unlocked configuration the tail 52 of toggle 16 is displaced out of, and in a different plane than, notch 54 of locking piece 22. As a result, rotation of spindle 24, i.e. an exterior load applied, may now cause the locking piece 22 to rotate along with the unlocking piece 20. In this configuration, the door, now unlocked, will permit spindle 24 to rotate when forces are applied to the exterior and or interior handles 2, 38.

Figure 8:
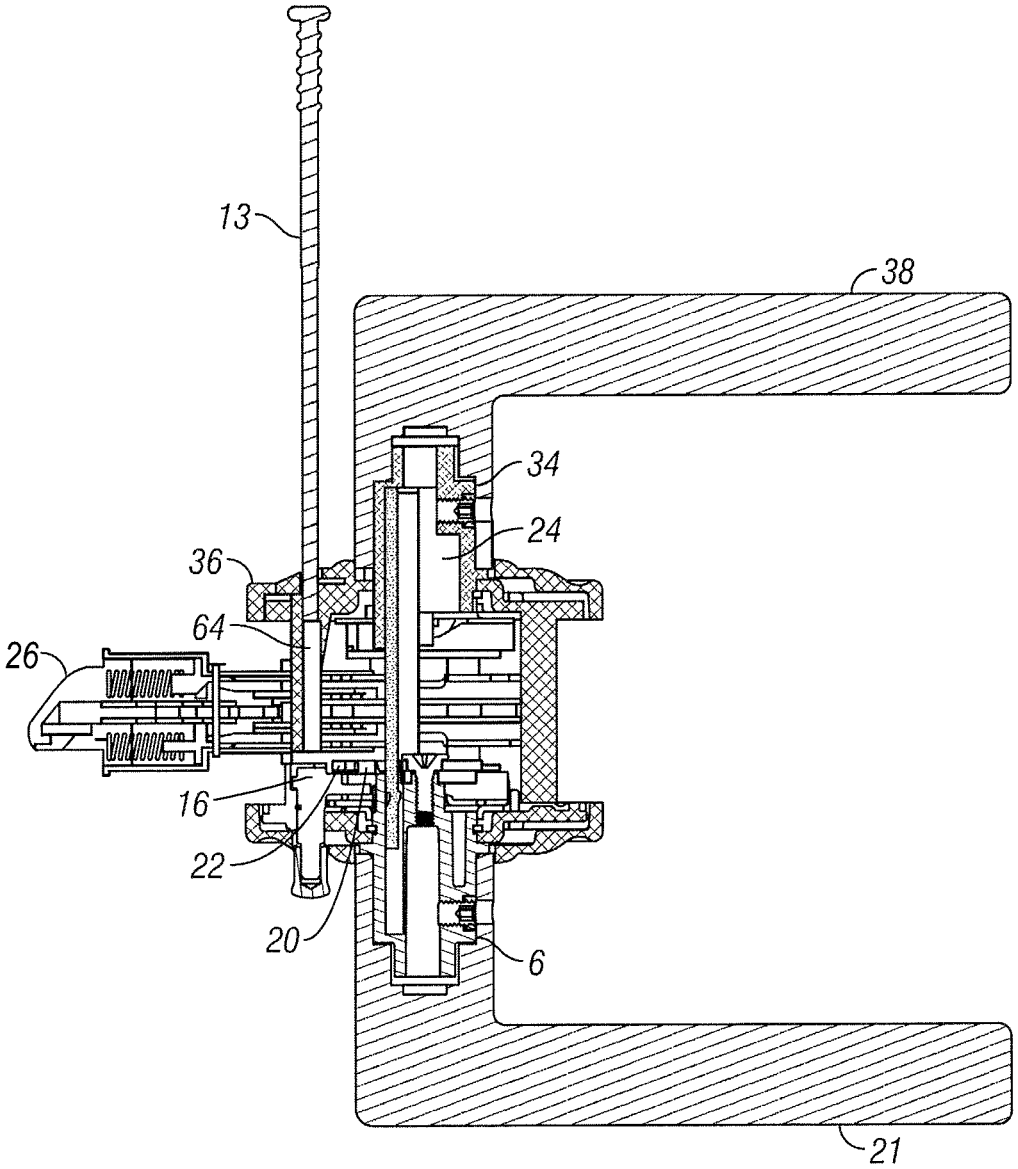
FIG. 8 is a top cross-sectional view of the interior chassis of the lock assembly of FIG. 1 with a tool inserted to unlock the lock assembly.

The lock assembly 1 can be unlocked from the exterior assembly side as illustrated in FIG. 8. A tool 13 may be provided that is configured to slidingly be deployed into a channel 64 extending through the exterior chassis 42 from the exterior rose 36. Channel 64 aligns with head 53 of toggle 16. Force applied by tool 13 to head 53 translates the toggle 16 so that the tail 52 translates out of the notch 54. This results in an unlocked configuration where the locking piece 22 can rotate along with the unlocking piece 20.

EXAMPLES

Illustrative examples of the privacy lock disclosed herein are provided below. An embodiment of the privacy lock may include any one or more, and any combination of, the examples described below.

In one example, lock assembly is provided with a chassis including an exterior and interior portion configured to extend from an exterior and interior of a door and a spindle extending between the exterior and interior portion to translate a door latch; an exterior spring housing and an interior spring housing coupled to the exterior and interior portions of the chassis, the exterior spring housing and interior spring housing each having compression springs; a locking mechanism having a locking piece that engages with a toggle offset from a central axis of the chassis to secure the lock assembly in a locked position; and means for unlocking the lock assembly from the interior portion by a camming motion so that the toggle is translated out of engagement with the locking piece thereby allowing the locking piece to rotate with the spindle.

In some examples, the means for unlocking the lock assembly includes an unlocking piece with a ramped segment and an interior insert coupled to an interior handle and the unlocking piece and rotation of the interior handle corresponds to rotation of the interior insert and unlocking piece. The ramped segment of the interior insert engages the toggle thereby translating the toggle out of engagement with the locking piece.

In some examples, the insert is configured to rotate a predetermined distance before engaging with and rotating the spindle.

In some examples, the exterior spring housing and interior spring housing are configured to keep an exterior handle and an interior handle at predetermined orientations when no outside load is applied to the exterior and interior handles.

In some examples, the lock assembly further comprises an exterior insert connecting the exterior handle to the exterior spring housing and an interior insert connecting the interior handle to the interior spring housing; and application of an outside load results in rotation of the exterior or interior handle which generates a load in the interior and exterior spring housings to return the interior and exterior handles to the predetermined positions when the outside load is removed.

In some examples, the toggle includes a toggle head and a toggle tail; the toggle tail configured to engage a keyed opening in the locking piece when in the locked position and the toggle head configured to engage an external tool extending through an opening in the exterior portion of the chassis to translate the toggle and disengage the toggle tail from the locking piece from the exterior portion.

In some examples, the toggle head is further mounted into body of a button that extends from an opening in the interior portion of the chassis; the button offset from the rotational axis of the spindle; wherein pushing and pulling load applications to the button result in engagement and disengagement of the toggle tail from the locking piece from the interior portion.

In another embodiment, a lock assembly comprising a chassis including an exterior and interior portion configured to extend from an exterior and interior of a door and a spindle extending between the exterior and interior portion to translate a door latch; an exterior spring housing and an interior spring housing coupled to the exterior and interior portions of the chassis, the interior spring housing and the exterior housing each comprising of compression springs; a locking mechanism having a locking piece that is keyed to engage with a toggle offset from a central axis of the chassis to secure the lock assembly in a locked position. The locking piece is keyed to receive a tail piece of the toggle. Translation of the tail piece out of the keyed locking piece unlocks the lock assembly into an unlocked position.

In some examples, the lock assembly further comprises an unlocking piece having a ramped surface that rotatably engages with the toggle to translate the tail piece out of engagement with the locking piece.

In some examples, the lock assembly further comprises an interior insert connecting an interior handle to the unlocking piece; wherein rotation of the interior handle corresponds to rotation of the interior insert and unlocking piece thereby engaging the ramped surface with the toggle.

In some examples, the toggle includes a head piece received in a button that is offset from a rotational axis of the spindle in the interior portion of the chassis; wherein push and pull loads applied to the button result in translation of the toggle between locked and unlocked positions In some examples, the lock assembly further comprises an opening in the external portion of the chassis that receives an elongate tool; wherein the opening is coaxial with the toggle head piece and the tool is configured to engage the toggle head piece and translate the tail piece out of engagement with the locking piece.

In some examples, the springs in the interior spring housing are configured to be compressed by an interior insert and the springs in the exterior spring housing are configured to be compressed by an exterior insert.

In some examples, the interior insert is configured to engage and compress the compression springs in the interior spring housing in response to an applied rotational force.

In some examples, the interior insert is configured to rotate when the rotational force is applied to an interior handle; and in response to release of the rotational force from the interior handle, the compressed springs in the interior spring housing return the interior handle to a predetermined unloaded position.

In some examples, the interior spring housing and exterior spring housing maintain interior and exterior handles at a predetermined orientation when no loads are applied to the handles.

In a further example, a method of operating a door locking assembly in a door comprising providing a lock assembly chassis having an interior portion including compression springs and an exterior portion including compression springs, the interior portion and exterior portion connected via a spindle which translates a latch bolt; locking the door by pressing a lock actuator toggle, offset from an axis of rotation of the spindle, into a keyed opening of a locking piece in the interior portion of the chassis; and unlocking the door by camming the toggle out of the keyed opening of a locking piece.

In some examples, the camming includes rotating an interior handle to rotate a ramped unlocking piece; wherein rotation of the ramped unlocking piece causes the ramped unlocking piece to engage an opening in the locking piece and translate the toggle out of the keyed opening of the locking piece.

In some examples, rotating the interior handle further engages and compresses the springs in an interior spring housing of the interior portion of the chassis; wherein the amount of compression is related to the amount of rotation.

In some examples, the method further comprises releasing the interior handle to release the compressed springs, thereby returning the interior handle to a predetermined orientation.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

The invention claimed is:

1. A lock assembly comprising:

a chassis including:

an exterior and an interior portion configured to extend from an exterior and an interior of a door, respectively; and a spindle extending between the exterior and interior portions to translate a door latch;

wherein, the exterior and interior portions each comprise:

exterior and interior inserts configured to operatively connect the spindle to an exterior and an interior handle; and exterior and interior spring housings, each having compression springs configured to bias the exterior and interior handles;

a locking mechanism having:

a locking piece operatively connected to the interior insert and configured to receive the spindle therein, a locking notch;

a toggle located offset from a central axis of the chassis and including a tail configured to be received into the locking notch to secure the lock assembly in a locked position; and an unlocking piece operatively connected to the interior insert and configured to receive the spindle therein, wherein, when the interior handle is actuated, the spindle will rotate the unlocking piece transferring a camming motion by a portion of the unlocking piece to the toggle so that the toggle is translated out of engagement with the locking piece, thereby allowing the locking piece to rotate with the spindle, wherein at least a portion of the unlocking piece radially overlaps the locking notch.

2. The lock assembly of claim 1, wherein the unlocking piece includes a ramped segment;

wherein, when the interior handle is actuated, the ramped segment of the unlocking piece engages the toggle thereby translating the toggle.

3. The lock assembly of claim 1, wherein the interior insert is configured to rotate a predetermined distance before engaging with and rotating the spindle.

4. The lock assembly of claim 1, wherein the exterior spring housing and the interior spring housing are configured to keep the exterior handle and the interior handle at predetermined orientations when no outside load is applied to the exterior and interior handles.

5. The lock assembly of claim 4, wherein application of an outside load results in rotation of the exterior or interior handle which generates a load in the interior and exterior spring housings to return the interior and exterior handles to the predetermined positions when the outside load is removed.

6. The lock assembly of claim 1, wherein the toggle includes a toggle head and a toggle tail, wherein the toggle tail is configured to engage a keyed opening in the locking piece when the lock assembly is in the locked position and the toggle head is configured to engage an external tool extending through an opening in the exterior portion to translate the toggle and disengage the toggle tail from the locking piece from the exterior portion.

7. The lock assembly of claim 6, wherein the toggle head is further mounted into a body of a button that extends from an opening in the interior portion, wherein the button is offset from the rotational axis of the spindle, wherein pushing and pulling load applications to the button result in engagement and disengagement of the toggle tail from the locking piece from the interior portion.

8. A lock assembly comprising:

an exterior and an interior portion configured to extend from an exterior and an interior of a door, respectively, wherein the exterior and interior portions each include exterior and interior inserts;

a spindle extending between the exterior and interior portion to translate a door latch, the exterior and interior portions being configured to operatively connect the spindle to an exterior and an interior handle;

exterior and interior spring housings, each having compression springs configured to bias the exterior and interior handles;

a toggle offset from a central axis of the exterior and interior portions;

a locking piece being keyed to engage with the toggle to secure the lock assembly in a locked position;

wherein the locking piece includes a keyed locking notch to receive a tail piece of the toggle; and an unlocking piece configured to receive the spindle therein, wherein at least a portion of the unlocking piece radially overlaps the locking notch, wherein translation of the tail piece out of the keyed locking notch positions the lock assembly into an unlocked position.

9. The lock assembly of claim 8, wherein the unlocking piece has a ramped surface that rotatably engages with the toggle to translate the tail piece out of engagement with the locking piece.

10. The lock assembly of claim 9, wherein the interior insert connects the interior handle to the unlocking piece, and wherein rotation of the interior handle corresponds to rotation of the interior insert and unlocking piece thereby engaging the ramped surface with the toggle.

11. The lock assembly of claim 8, wherein the toggle includes a head piece received in a button that is offset from a rotational axis of the spindle in the interior portion, wherein push and pull loads applied to the button result in translation of the toggle between locked and unlocked positions.

12. The lock assembly of claim 11, further comprising an opening in the external portion that receives an elongate tool, wherein the opening is coaxial with the toggle head piece and the tool is configured to engage the toggle head piece and translate the tail piece out of engagement with the locking piece.

13. The lock assembly of claim 8, wherein the springs in the interior spring housing are configured to be compressed by the interior insert and the springs in the exterior spring housing are configured to be compressed by the exterior insert.

14. The lock assembly of claim 13, wherein the interior insert is configured to engage and compress the compression springs in the interior spring housing in response to an applied rotational force.

15. The lock assembly of claim 14, wherein the interior insert is configured to rotate when the rotational force is applied to the interior handle, and in response to release of the rotational force from the interior handle, the compressed springs in the interior spring housing return the interior handle to a predetermined unloaded position.

16. The lock assembly of claim 13, wherein the interior spring housing and the exterior spring housing maintain the interior and exterior handles at a predetermined orientation when no loads are applied to the handles.

17. A lock assembly comprising:

an exterior and an interior portion configured to extend from an exterior and an interior of a door, respectively, wherein the exterior and interior portions each include exterior and interior inserts;

a spindle connectable to the exterior and interior portions to translate a door latch, the exterior and interior portions being configured to operatively connect the spindle to an exterior and an interior handle, respectively;

an exterior spring housing and an interior spring housing coupled to the respective exterior and interior portions, the exterior and interior spring housings each having compression springs configured to bias the exterior and interior handles;

a locking mechanism having a locking piece;

a toggle offset from a central axis of the exterior and interior portions, the toggle being engagable with the locking piece of the locking mechanism to secure the lock assembly in a locked position, the toggle including:

a toggle head;

a button connected to the toggle head, the button extending from an opening in the interior portion, wherein the button is offset from a rotational axis of the spindle; and a toggle tail, wherein the toggle tail is configured to engage the locking piece when the lock assembly is in the locked position, wherein the toggle tail has a rectangular cross section; and an unlocking piece operatively connected to the interior insert and configured to receive the spindle therein, wherein, when the interior handle is actuated, the spindle will rotate the unlocking piece transferring a camming motion to the toggle so that the toggle is translated to position the lock assembly in an unlocked position.

18. The lock assembly of claim 17, wherein push and pull loads applied to the button result in translation of the toggle to actuate the lock assembly between locked and unlocked positions.

19. The lock assembly of claim 17, wherein the button is removable from the toggle head.

20. The lock assembly of claim 17, wherein the toggle head is mounted into a body of the button.

* * * * *